US005440771A

United States Patent [19]

Georgantas

[11] Patent Number: 5,440,771

[45] Date of Patent: Aug. 15, 1995

[54] JET DYEING APPARATUS AND METHOD

[75] Inventor: Aristides Georgantas, Athens, Greece

[73] Assignee: S. Sclavos S.A., Athens, Greece

[21] Appl. No.: 222,090

[22] Filed: Apr. 4, 1994

Related U.S. Application Data

[63] Continuation-in-part of Ser. No. 793,403, Feb. 13, 1992, Pat. No. 5,299,339.

[51] Int. Cl.[6] ..... D06B 3/24

[52] U.S. Cl. ..... 8/149.3; 8/151; 8/152; 68/178; 68/177

[58] Field of Search ..... 68/62, 177, 178, 175, 68/176; 8/151, 152, 149.1, 149.3

[56] References Cited

U.S. PATENT DOCUMENTS

| | | | |
|---|---|---|---|
| 1,041,031 | 10/1912 | Craig . | |
| 1,074,567 | 9/1913 | Gantt . | |
| 1,665,624 | 4/1928 | Conrad . | |
| 2,228,050 | 1/1941 | Collier | 68/177 |
| 2,403,311 | 7/1946 | Steele | 28/1 |
| 2,579,563 | 12/1951 | Gallinger | 68/5 |
| 3,587,256 | 6/1971 | Spara | 68/177 |
| 3,802,840 | 4/1974 | Chiba et al. | 8/152 |
| 3,949,575 | 4/1976 | Turner et al. | 68/5 |
| 3,982,411 | 9/1976 | Kreitz | 68/177 |
| 4,023,385 | 5/1977 | Hurd | 68/62 |
| 4,041,559 | 8/1977 | von der Eltz | 8/49 |
| 4,142,385 | 3/1979 | Sandberg et al. | 68/178 |
| 4,318,286 | 3/1982 | Sturkey | 68/178 |
| 4,716,744 | 1/1988 | Turner et al. | 68/62 |
| 4,766,743 | 8/1988 | Biancalani et al. | 68/20 |
| 4,803,208 | 4/1988 | Ekstroem | 68/181 |

FOREIGN PATENT DOCUMENTS

| | | |
|---|---|---|
| 7438537 | 11/1974 | France . |
| 2315564 | 1/1977 | France . |
| 2140788 | 2/1973 | Germany . |
| 85085038 | 4/1982 | Japan . |
| 90062336 | 6/1988 | Japan . |
| 2004927 | 9/1977 | United Kingdom . |
| 2031969 | 10/1978 | United Kingdom . |
| WO91/1841 | 11/1991 | WIPO . |

*Primary Examiner*—Frankie L. Stinson
*Attorney, Agent, or Firm*—Bell, Seltzer, Park & Gibson

[57] ABSTRACT

An improved jet dyeing apparatus is provided which enables the user to dye either lightweight or relatively heavy weight fabrics in the same apparatus with improved efficiency and product quality. The apparatus includes a fabric plaiting mechanism mounted to the exit end of a transport tube and a downwardly directed outlet nozzle. The outlet nozzle further includes dye liquor bypass means for withdrawing a portion of the dye liquor outside the primary path of travel of the fabric as the fabric is deposited into the liquid treatment chamber of the apparatus and provision is also made for removing a portion of the contaminated liquor from the jet dyeing apparatus. By virtue of this arrangement an improved high efficiency rinse cycle is enabled in accordance with the related method which is also disclosed.

9 Claims, 4 Drawing Sheets

JET DYEING APPARATUS AND METHOD

BACKGROUND OF THE INVENTION

This application is a continuation-in-part of earlier application Ser. No. 07/793,403 which was filed on Feb. 13, 1992, now U.S. Pat. No. 5,299,339.

This invention relates to a jet dyeing apparatus for dyeing textile materials which is particularly desirable for use in dyeing textile fabrics in rope form. In apparatuses of this type, the fabric to be treated is continuously circulated through a treatment zone or transport tube in which dye liquor is applied to the fabric under pressure. The pressurized liquor serves a dual function, namely to dye the fabric as well as to impart movement to the fabric rope which is conveyed from the transport tube into a fabric storage chamber. Within the storage chamber, the fabric is submerged in excess dye liquor and moves through this chamber suspended in the liquor until it is removed from the opposite end for conveyance through the transport tube whereupon the cycle is repeated.

As noted, pressurized dye liquor is applied to the fabric in the fabric transport tube. For this purpose, the tube typically includes at least one peripheral liquor sprayer or "P.L.S." which is designed to apply the liquor under pressure to the fabric about its complete circumference. It is particularly desirable to apply the pressurized liquor in a way which enhances the interchange between the dyestuffs and the fabric in order to enhance the uniformity of the dye application to the fabric. In order to dye the fabric successfully, however, it is also necessary that the fabric travel at relatively high speeds through the transport tube, but while still ensuring that the desired level of liquor-fabric interchange occurs.

In order to increase operating speeds, it is customary to utilize relatively high liquor pressures in the peripheral liquor sprayer, for example, in order to enhance fabric throughput and fabric-liquor interchange. Unfortunately, the use of high water pressures often results in damage to the surface of the fabric (i.e., peeling or pitting) and "stitch" deformation. The problem is particularly acute with lightweight fabrics which are more susceptible to damage from the relatively high pressures which means that the fabric finisher must typically either reduce his operating rates or compromise the quality of the resulting dyed products.

Representative jet dyeing machines for dyeing fabrics in continuous rope form are shown, for example, in U.S. Pat. Nos. 3,587,256 (Spara), 3,949,575 (Turner, et al.), 3,982,411 (Kreitz), 4,083,208 (Ekstroem), and 4,318,286 (Sturkey). The art-recognized problems of surface degradation in dye treatments, and with lightweight fabrics in particular, are described in Kreitz and Sturkey. For his part, Kreitz suggests that a plurality of nozzles be utilized of differing construction depending upon the type of fabric to be treated in the jet dyeing apparatus. This increases downtime since the apparatus must be modified each time the weight of the fabric to be treated in the jet dyeing apparatus is changed materially. As an alternative, Sturkey proposes the use of a modified j-box and an elongate liquor transport tube which has a steep upward incline in order to ensure, according to Sturkey, that the treated fabric will be conveyed through the transport tube with relatively reduced surface degradation. The problem in the Sturkey device, however, is that the use of a single liquor sprayer at the inlet in combination with the elongate tube, means that extremely high pressures must be used in order to maintain any reasonable throughput through the jet dyeing machine.

A still further modified jet dyeing apparatus is described in U.S. Pat. No. 4,083,208 to Ekstroem which also recognizes the problem presented by the desire to use the same jet dyeing apparatus for the purpose of dyeing either lightweight or heavier fabrics as well as yarns. Ekstroem suggests the use of a discharge pipe of varying undulated constructions which also requires changes in piping construction depending upon the weight of the fabric to be treated. Furthermore, Ekstroem advocates the use of a perforated region in the undulated pipe for the purpose of reducing the rate of travel in the fabric, ostensibly for the reason of reducing turbulence at the discharge point, but with the result that substantial liquor will be drained from the fabric while it is still in the transport chamber, and with the additional result that the capacity of the apparatus will be unduly restricted.

Additional fabric transporting arrangements are shown in U.S. Pat. Nos. 1,665,624 (Conrad), 2,228,050 (Collier), 2,403,311 (Steele), 3,802,840 (Chiba, et al.), 4,041,559 (Von Der Eltz), 4,142,385 (Sandberg, et al.), 4,766,743 (Biancalani, et al.), and in United Kingdom patent application 2,031,969, French publication no. 2,315,564, and German Offenlegungschrifft 2,140,788 which depicts an apparatus for loading and unloading textile material to be wet treated.

Even where higher throughput rates in the fabric transport tube are achieved, related problems can arise which limit the effective capacity of the jet dyeing apparatus. Specifically, it is customary in dyeing fabrics that the fabric leaving the fabric transport tube is delivered into the storage chamber, which is otherwise referred to as the "j-box" or keir. The apparatus which controls the placement of the fabric within the storage chamber or j-box is typically referred to as the "plaiter". It is customary in plaiting the fabrics to induce the formation of longitudinal folds in the fabric as shown, for example, in U.S. Pat. Nos. 4,318,286 (Sturkey) and in 4,023,385 (Hurd), the latter of which describes an oscillating valve for inducing formation of the folds through the use of air pressure. These arrangements can create problems in the form of entanglement of the fabric in the chamber and are inefficient because the capacity in the storage chamber is under-utilized.

Alternative arrangements for plaiting fabrics in a jet dyeing machine are shown in U.S. Pat. No. 2,579,563 to Gallinger and in United Kingdom patent application 2,004,927 ("Mezzera"). In accordance with the disclosures in these additional references, a plaiting nozzle is oscillated transverse to the direction of travel of the fabric through the fabric transport tube and is also preferably oscillated in a longitudinal direction (using the hood 21 in Mezzera, for example) or by axial movements of the discharge nozzle in accordance with the embodiment shown in FIG. 4 of Mezzera. The transverse and longitudinal action results in a parallelepiped arrangement of the fabric which is said to improve the stability of the stored fabric in the j-box in order to attempt to minimize occurrences of fabric entanglement within the j-box or storage chamber.

As an alternative to the simultaneous plaiting of the fabric in both the longitudinal and transverse orientations, it is also known in the art that the entire fabric transport tube, including a fixed plaiting nozzle, may be oscillated in a direction transverse to the main path of travel of the fabric. While this approach forms generally transverse folds in the fabric, it substantially limits the production capacity of the apparatus and increases wear and tear on the entire assembly. Furthermore, the fabric is deposited in the fabric storage chamber in a generally arcuate pattern which is inherently unstable and which wastes the available capacity in the fabric storage chamber.

A similar problem of the instability of the fabric leading to entanglement also arises from the use of a fabric discharge nozzle of the orientation shown in the Mezzera United Kingdom reference described above since the angle of the discharge nozzle is disposed outwardly in a manner which will inherently deposit the fabric in a generally arcuate pattern as it is placed in the j-box. This stack is inherently unstable and wastes capacity within the storage chamber. Here again, the most significant problems are presented by lightweight fabrics and, as noted above, it is particularly desirable to provide a jet dyeing apparatus which is effective for dyeing both lightweight as well as heavier weight fabrics while maximizing the overall capacity of the apparatus.

It is also desirable in connection with the jet dyeing of fabrics to provide an effective means for rinsing unwanted impurities from the treated textile materials after wet processing in order to obtain optimum results. The easiest way to obtain acceptable results is to rinse at a high liquor to goods ratio with many changes in fresh liquor. However, with increasing costs of water and waste water treatment, it has become necessary in the art to devise rinsing techniques and apparatuses which are effective with much lower water consumption.

An added complication arises from the fact that in many cases it is undesirable to drain the liquor completely in the first rinsing stage (i.e., "drop fill rinsing"). For example, in the exhaust dyeing of cellulosic fibers with sulfur dyes, the dye is exhausted onto the fibers from a strongly reducing alkaline liquor. Subsequently the dye is oxidized on the fiber to render the dye insoluble in water. In order to prevent localized premature oxidation, the reduction potential of the liquor and the concentration of alkaline must be reduced gradually and evenly as the dye concentration is reduced. The use of drop fill rinsing can cause "bronzing" as a result of the migration of dye to the surface and oxidation on the fiber surface instead of within the interstices of the fiber structure. Therefore, a technique known as "overflow rinsing" must be utilized in connection with this and other dyeing techniques. Unfortunately, overflow rinsing involving the introduction of fresh water may be inefficient in terms of water consumption and time. Accordingly, there is also a need in the art for an apparatus which enables effective rinsing of the fabric while minimizing water consumption and the time associated with the rinse cycle.

SUMMARY OF THE INVENTION

In accordance with the present invention, the desired object of maximizing capacity while minimizing tension and creasing of the fabric in the "J"-box leading to entanglements is achieved by providing a jet dyeing apparatus which includes a housing having a liquid treatment chamber positioned in the lower portion of the housing which has an upwardly open inlet and an upwardly open outlet. The apparatus also includes a fabric transport tube in the housing positioned above the liquid treatment chamber which comprises an elongate tubular member which defines a generally horizontal centerline which has an exit end for mounting a plaiting apparatus. A plaiting apparatus is also provided in accordance with this aspect of the invention, which member is mounted to the exit end of the transport tube for relative rotation about its centerline and which includes a downwardly directed outlet nozzle which overlies the inlet to the liquid treatment chamber. Finally, means for oscillating the plaiting member about the centerline are provided such that the downwardly directed nozzle reciprocates along a generally linear path of travel which is transverse to the centerline of the transport tube such that fabric passing through the tube is deposited in overlying relatively straight folds in the chamber to maximize capacity and improve the stability of the fabric entering the storage chamber.

Also in accordance with a particularly preferred aspect of the present invention, increased capacity may be attained through the use of a fabric transport tube which includes a plurality of peripheral liquor sprayer systems or other jets which are fed with dyeing liquor from a common supply. In this fashion as described herein, the highest fabric speeds may be achieved at the lowest possible water pressure. In accordance with this aspect of the invention, the first peripheral liquor sprayer is preferably placed at the entry end of the fabric transport tube, i.e. the fabric inlet to the fabric transport tube, while a second peripheral liquor sprayer is preferably positioned just beyond the midpoint of the fabric transport tube. In addition, the section of the fabric transport tube between the first peripheral liquor sprayer and the approximate midpoint of the transport tube defines a first transport zone which is preferably downwardly inclined at a mild angle while the section of the fabric transport tube after the midpoint and containing the second peripheral liquor sprayer, is generally upwardly inclined toward the plaiting nozzle to define a second transport zone.

The use of a plurality of liquor sprayer systems in accordance with the invention will correspondingly increase the volume of liquor which is applied to the fabric in the fabric transport tube to enhance the liquor-fabric interchange within the transport tube. In this fashion, the attainment of relatively higher throughput rates may be accomplished despite the fact that relatively lower output pressures may be utilized at each of the peripheral liquor sprayers, respectively, to improve the quality of the dyed products.

As noted, the use of a plurality of peripheral liquor sprayers will increase the overall volume of liquor traveling through the fabric transport tube with the further result that greater volumes of excess liquor will be deposited by the outlet nozzle of the plaiter onto the orderly fabric pleats previously formed by the plaiting mechanism. In order to avoid disruption of the orderly pattern of the fabric pleats which have been formed previously in the j-box, the invention may additionally include an excess liquor bypass which may be desirably formed integrally with the outlet nozzle of the plaiting mechanism. The excess liquor bypass is formed on the outer curve of the elbow defining the outlet nozzle and adjacent the defined path of travel for the fabric. In view of the pressures which are preferably employed in operation, the excess liquor will travel through a perforated plate in the outlet nozzle so that the liquor is diverted outside the main area of the liquid treatment chamber so that a relatively small percentage of dye liquor entering the liquid treatment chamber falls directly on the fabric which has been plaited. The excess liquor may then travel through a distinct path of travel and may be in fluid communicating relation to the chamber through perforations or the like so that the liquor may then be recirculated to the header associated with the peripheral liquor sprayers.

The outlet nozzle and the excess liquor bypass also form part of an alternative assembly which is designed to enhance the efficiencies associated with the rinsing process. In accordance with this aspect of the invention, fresh water, including preferably hot water, may be introduced directly to the peripheral liquor sprayers and a portion of the highly contaminated wash liquid is then removed in order to obtain some of the advantages of drop fill rinsing (i.e., the introduction of fresh water and the removal of highly contaminated effluent) while also achieving the benefits associated with overflow rinsing since the apparatus will not be fully drained in the rinse cycle in order to achieve enhanced efficiencies.

The unique plaiting system as described herein deposits the fabric in the storage chamber in an orderly manner so that the full width of the chamber is utilized and so that each new plait of fabric is deposited in overlying relatively straight folds square to the centerline of the storage chamber. In this manner, the fabric remains relatively undisturbed until it reaches the front exit of the storage chamber and helps to ensure that entanglement of the stored fabric as it moves through the storage chamber will be minimized or avoided completely. In addition, the use of a plurality of liquor sprayers as described in conjunction with the preferred transport tube enables the attainment of relatively higher operating speeds while minimizing the likelihood of fabric degradation in the process.

This invention also relates to the method of dyeing a length of textile material as described herein which includes the steps of guiding a length of textile material through a generally horizontally directed transport tube while applying a jet of liquid dye onto the material in the tube to dye the fabric and advance it through the transport tube. The textile material is then advanced downwardly from the exit end of the transport tube and reciprocated along a linear path of travel transverse to the direction of advance through the transport tube so as to form overlying relatively straight folds of the material in the transport chamber.

BRIEF DESCRIPTION OF THE DRAWINGS

Additional features of the invention will be described hereinbelow in conjunction with the accompanying drawings in which.

DESCRIPTION OF THE PREFERRED EMBODIMENTS

Figure 1:
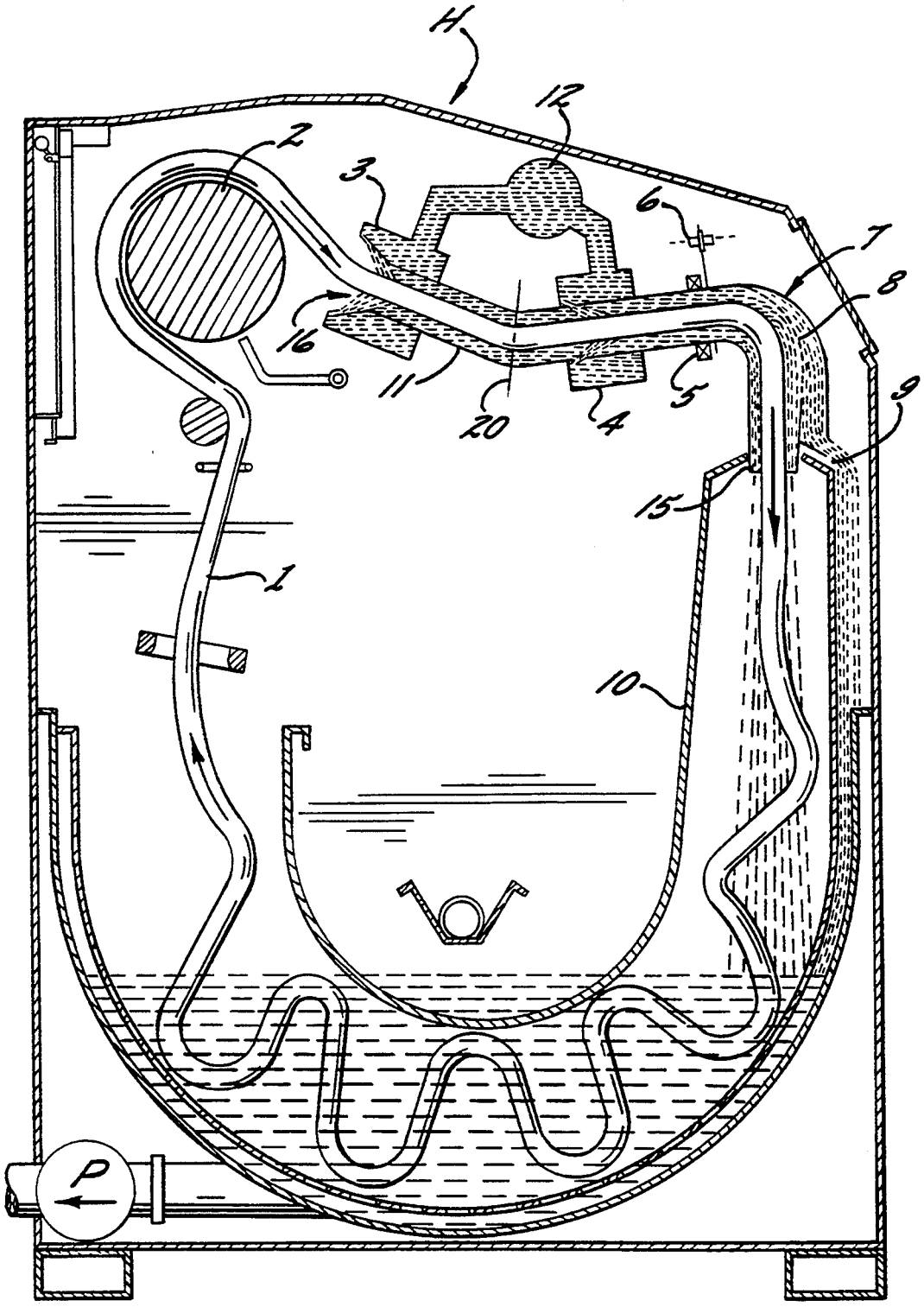
FIG. 1 is a side schematic view showing the general arrangement of the fabric transport tube and particularly in relation to the j-box or liquid treatment chamber.
Figure 2:
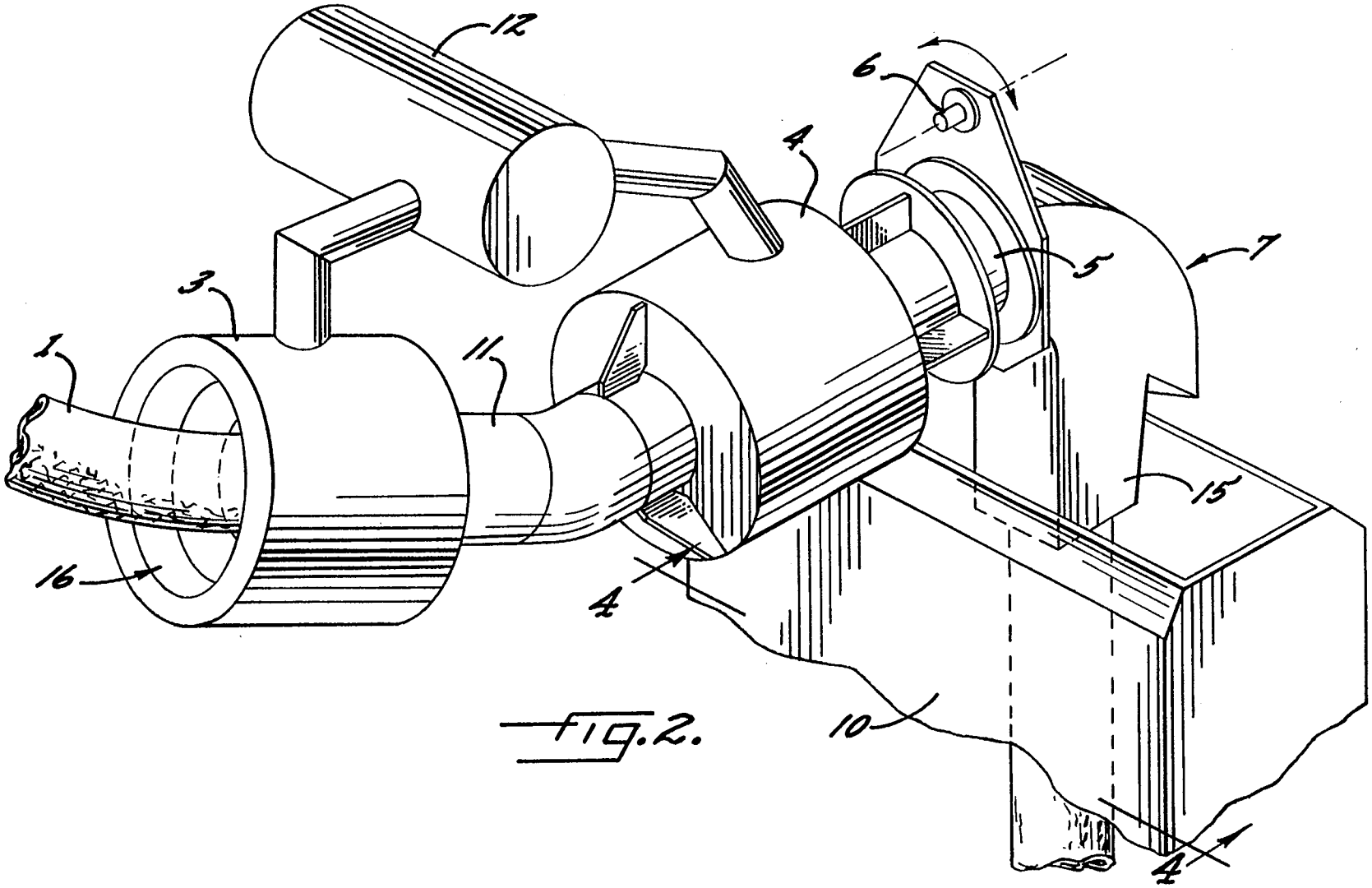
FIG. 2 is a side perspective view which particularly depicts the fabric transport tube and the plaiting mechanism made in accordance with this invention to deposit the fabric in an orderly way within the liquid treatment chamber and also depicting the preferred rectangular design of the outlet nozzle.

As shown in schematic form in FIG. 1 the jet dyeing apparatus comprises a housing H which includes a liquid treatment chamber or j-box 10 in the lower portion of the housing and a fabric transport tube 11 in the housing above the liquid treatment chamber. In use, the fabric 1 enters the fabric transport tube 11 with the assistance of a driven rotating cylinder 2 as is customary in jet dyeing apparatuses of this general type.

The fabric enters the fabric transport tube 11 at a fabric inlet or entry end 16 and is immediately contacted with liquor from a jet apparatus or peripheral liquor sprayer 3 which is supplied with liquor from a common supply or header 12. The preferred peripheral liquor sprayer sprays liquor on the fabric in a manner which both dyes the fabric and which also serves to transport the fabric 1, which is typically in continuous rope form, along the longitudinal direction of the fabric transport tube 11 and ultimately to the plaiter mechanism 7.

In accordance with the present invention, the fabric transport tube 11 preferably includes a plurality of peripheral liquor sprayers including the first aforementioned sprayer 3 at the inlet or entry end 16 to the fabric transport tube 11 and a second peripheral liquor sprayer 4. The two peripheral sprayers are preferably supplied by a common header 12. In accordance with the preferred arrangement shown in FIG. 3, the second peripheral liquor sprayer 4 is preferably positioned downstream of the first peripheral liquor sprayer 3 and closely adjacent the midpoint 20 of the fabric transport tube 11. As shown, the nozzle of the second peripheral liquor sprayer 4 is spaced approximately 135 mm from the approximate midpoint 20.

Figures 3, 4:
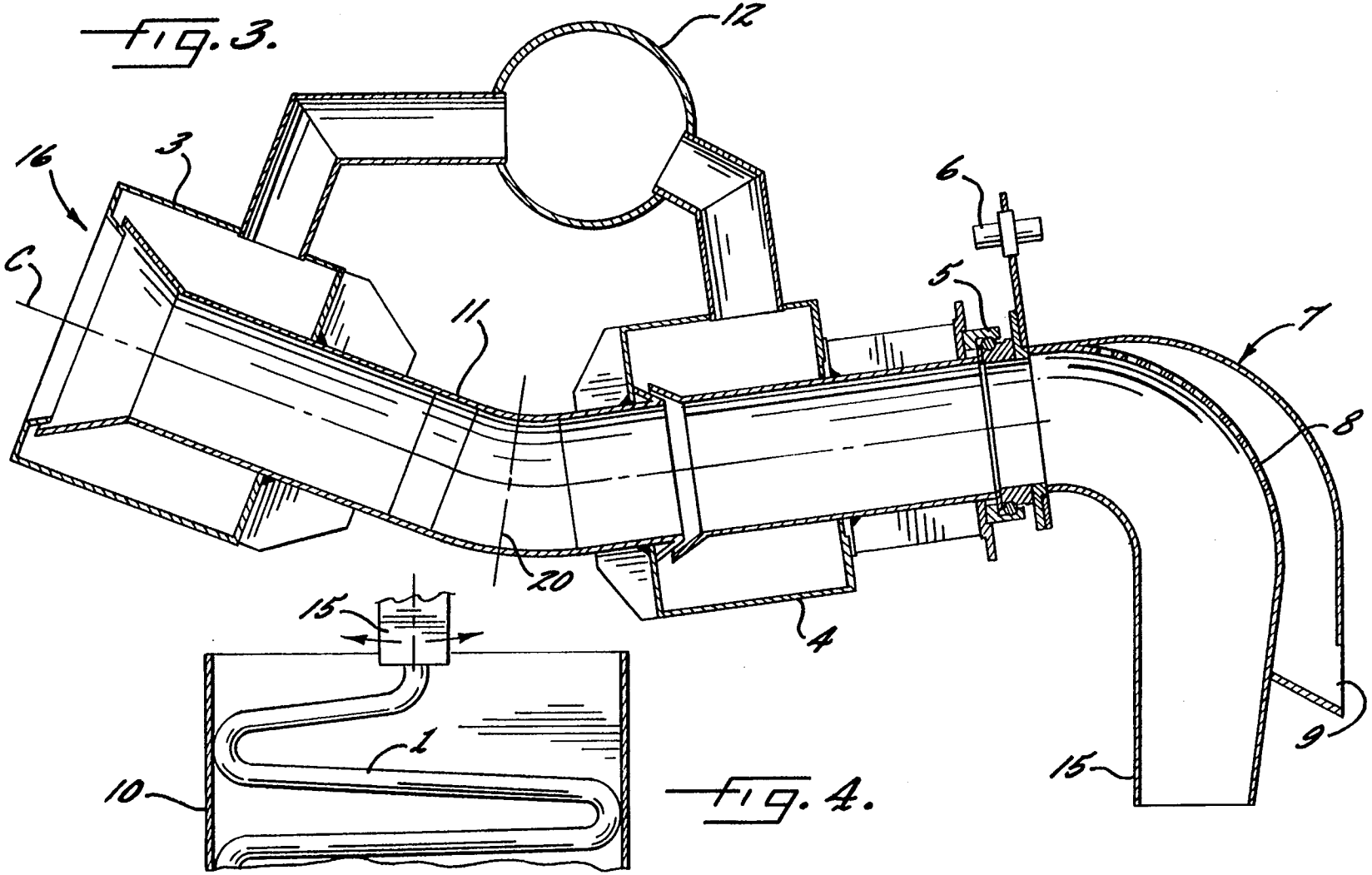
FIG. 3 is a detailed side elevation view depicting the fabric transport tube and the plaiting mechanism including the outlet nozzle in detail in accordance with the present invention.
FIG. 4 is a front schematic taken substantially along the line 4—4 in FIG. 2 and depicting the general pattern of deposition of the fabric in accordance with the invention.

In accordance with one aspect of this invention, and as shown particularly in FIG. 3, the fabric transport tube 11 defines a generally horizontal centerline C (FIG. 3). In addition, the transport tube 11 is preferably downwardly inclined in the region between the entry to the fabric transport tube 16 at the first peripheral liquor sprayer 3 and then upwardly inclined beginning near the midpoint of the fabric transport tube 20. In this manner, a first transport zone is defined commencing at the fabric inlet to the fabric transport tube 16 where the first peripheral liquor sprayer 3 is positioned, and then extending at a generally downward mild incline to the approximate midpoint 20 of the fabric transport tube 11 whereupon a second transport zone intersects the first transport zone at the lowermost point in the fabric transport tube and then extends at a gentle slope upwardly at an incline to the outlet of the fabric transport tube defined by the means mounting the plaiter mechanism 5.

In accordance with the preferred embodiment, the fabric transport tube will have a shallow v-shaped outline in profile. In this manner, the fabric transport tube 11 will be flooded with dye liquor to improve the liquor fabric interchange within the fabric transport tube, but without significantly impeding the progress of the fabric through the transport tube. In addition, this design creates a slight turbulence which tends to rearrange the fabric folds leaving the first transport zone prior to treatment in the second peripheral liquor sprayer 4.

The effective pressures at the nozzles of the peripheral liquor sprayers 3 and 4 may be varied in accordance with the invention, but will typically range from 0.1 to 0.5 bar which will correspondingly affect the speed of travel for the fabric 1 through the fabric transport tube 11. For example, in the arrangement as particularly depicted in detail in FIG. 3, the rate of travel for the fabric attainable with this arrangement is approximately 110 meters per minute at 0.10 bar inlet pressure and rises to a rate of approximate 240 meters per minute at a corresponding water pressure of 0.40 bar at the peripheral liquor sprayers 3 and 4. The angle defined by the interior diameter of the fabric transport tube and the sidewall of the nozzle within the peripheral liquor sprayer may also be varied but as shown is approximately 30 degrees.

The included angle defined between the two sections of the fabric transport tube at the midpoint 20 also may be varied in accordance with the invention, but will preferably fall in the range from about 110 to about 180 degrees and preferably in the range from about 130 to 160 degrees to define the slight "v" shape in profile. As shown in FIG. 3, the particular preferred arrangement defines an included angle of about 150 degrees at the midpoint 20 which is the junction between the first transport section and the second transport section.

The overall length of the fabric transport tube 11 also may be varied in accordance with the present invention as may be the approximate length of the first and second transport zones defined by the fabric transport tube. For example the length of the first transport zone which is defined by the distance from the entry point 16 to the fabric transport tube 11 to the approximate midpoint 20 may vary in the range from 200 to 800 millimeters and is approximately 500 millimeters in the particular arrangement as depicted in the drawings. The length of the second transport zone also may be varied over similar ranges and is preferably approximately the same length as the first section and at approximately the same positive angle corresponding to the negative angle applied in the first transport zone, so that the outlet of the fabric transport tube at the plaiting mechanism 7 at the bearing 5 will lie at approximately the same elevation as the entry point 16 at the first peripheral liquor sprayer 3.

In accordance with the present invention, a unique plaiting mechanism 7 is provided. The curved plaiter 7 directs the fabric vertically downwardly into the liquid treatment chamber or storage chamber 10 (FIG. 1). The curved plaiter 7 is preferably of rectangular cross-section throughout its length and may be a square. The base of the plaiter is preferably mounted on a circular bearing 5 at the exit end of the fabric transport tube and preferably comprises a stainless steel spherical ball roller bearing 5 which is rotatably fixed to the end of the fabric transport tube. In this manner, the entire plaiting mechanism 7 may be oscillated rapidly about the centerline of the transport tube C. The plaiter 7 defines an outlet nozzle 15 which extends downwardly into fluid communicating relationship with the inlet to the liquid treatment chamber 10. As noted, the plaiting mechanism is mounted on a circular bearing 5 about which it may be oscillated in any known fashion through the reciprocating action of oscillation means 6. The plaiter may be oscillated at rates ranging from 10 to 50 complete strokes per minute and travels in a path which preferably defines a straight line across the complete width of the inlet to the liquid treatment chamber.

Also in accordance with the invention, the outlet nozzle 15 defined by the plaiter 7 is oriented approximately 90 degrees to the chamber centerline and is also substantially perpendicular to the longitudinal axis or centerline C of the fabric transport tube 11. If the tube 11 is substantially straight then the angle defined between the centerline C and the nozzle 15 will be around approximately 90 degrees. Since the centerline C of the transport tube 11 will vary in its geometry from a straight line, and particularly in accordance with the preferred embodiments, the exact angle may vary and it is only important that the outlet nozzle 15 is downwardly directed and reciprocates along a generally linear path of travel which is transverse to the centerline and such that the fabric material 1 passing through the transport tube 11 is deposited in the inlet of the liquid treatment chamber in overlying been assigned similar reference characters, so that the plaiter assembly 7 has been assigned reference character 107 in FIG. 5, the bypass nozzle 9, has been assigned reference character 109, etc. In accordance with this alternative arrangement, the excess liquor diverted through the bypass nozzle 109 is directed to an overflow trough 125 which is in fluid communicating relationship with drain assembly 127 and valve 126, which is preferably an automatic valve. Also in accordance with this alternative assembly, a fresh water inlet 128 is preferably positioned in fluid communicating relationship with the liquor recirculation line 130, and preferably adjacent the recirculating pump P, which is generally located adjacent the bottom of the liquid treatment chamber.

In this manner, fresh water may be introduced directly to the peripheral liquor sprayers 103 and 104 through header 112. Accordingly, fresh water, and preferably hot water, where applicable, may be introduced into direct intimate contact with the fabric during the rinse cycle and then a portion of this rinse water containing the highest impurities (such as the portion obtained when the rinse cycle is initiated) may be drained without contaminating the bulk of the liquor in the bottom of the liquid treatment chamber or "j-box" 110.

The net rate of removal of the rinse water may be further controlled through appropriate sizing of relatively straight folds. For example, where the shallow v-shaped profile of the transport tube is employed as illustrated, the angle defined between the second transport zone defining a portion of the centerline C and the outlet nozzle 15 will be less than about 90 degrees. In this manner, the path of travel of the nozzle 15 will be a straight line across the width of the storage chamber 10 in contrast to prior art devices.

The present invention also preferably includes a liquor bypass 8 in the plaiter assembly 7 which includes a bypass nozzle 9 which preferably communicates with the storage chamber through a path which is longitudinally spaced apart from the main path of travel of the fabric entering the storage chamber 10. In this manner, the water under pressure will tend to follow a straight line while the weight of the fabric facilitates its deflection into the liquid treatment chamber. This ensures that the liquor which is allowed to escape through the bypass nozzle 9 will not disturb the plaiting operation occurring within the treatment chamber 10. Thereafter, excess liquor in the chamber 10 is recirculated by the pump P to the header 12.

Figure 5:
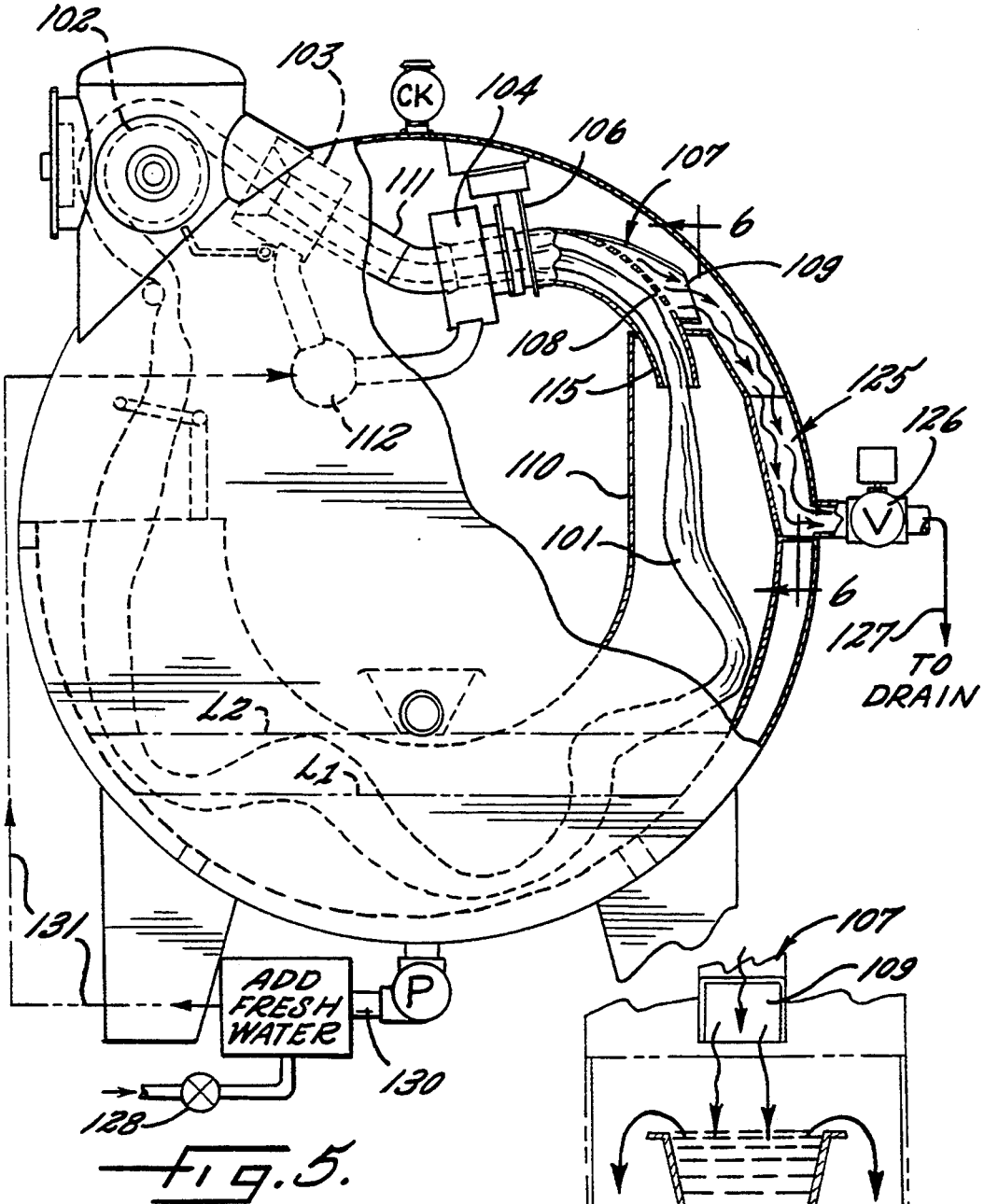
FIG. 5 is a side schematic view showing an alternative embodiment which incorporates the preferred arrangement for performing a fabric rinsing treatment in accordance with an optional, preferred aspect of this invention.
Figure 6:
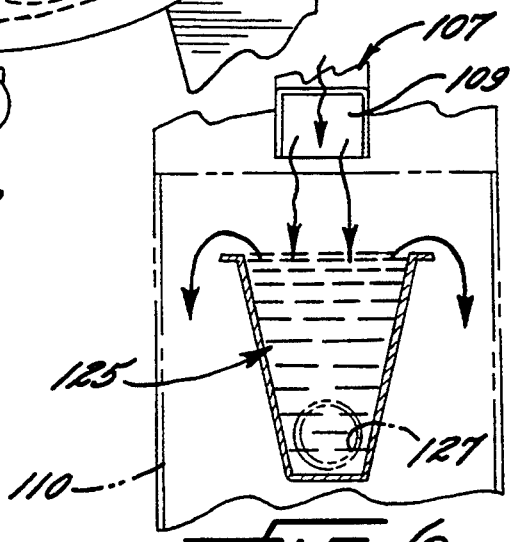
FIG. 6 is a detailed front elevation view taken along the line 6—6 of FIG. 5 particularly depicting the overflow assembly for removing a portion of the contaminated liquor during the fabric rinsing cycle.

An alternative arrangement is depicted in FIGS. 5 and 6. This assembly retains much of the basic arrangement of the preferred dyeing apparatus as described above and the corresponding elements have the drain pipe 127 positioned in the trough 125 so that only a portion of the liquor is removed. In particular, the flows are controlled so that the amount of fresh water introduced through valve 128 is roughly equivalent to the amount which is being removed through drain assembly 127 and valve 126. Exemplary flow rates for the system may be in the range from about 200–300 liters per minute per "port" (i.e., a corresponding jbox section), where each port has a fabric capacity of approximately 150 to 180 kilograms. In an apparatus having these approximate capacities, the cross-section of the fresh water inlet 128 for the rinse cycle may be in the range from about 7–9 square centimeters while the drain pipe 127 may have a corresponding dimension in the range from about 14 to 18 square centimeters; the difference in dimensions resulting from the introduction of the liquid at the fresh water inlet 128 to the header 112 under pressure, while the contaminated liquid flowing through drain piping 127 is removed largely by gravity.

The introduction of fresh rinse water may desirably be combined with a conventional overflow rinse procedure, with the liquor level within the treatment chamber being maintained between two levels (FIG. 5), with L1 indicating a representative, preferred minimum liquor level and L2 indicating a representative, preferred maximum liquor level during the combined rinse process. The precise levels may be adjusted by the operator depending upon the particular dyeing system in use to provide optimum results. When the liquor level is between levels L1 and L2, both the filling valve for overflow rinsing and the drain valve 126 are open. If the liquor level drops in the treatment chamber to level L1, level switches may be provided (not shown) to automatically close the drain valve 126 to allow the liquor level within the treatment chamber to return to level L2. In a related vein, the liquor levels are preferably regulated between a ratio of 1:5 at level L1 and 1:7 at level L2.

Through the use of the modified apparatus of FIG. 5, some of the advantages of "drop fill rinsing" may be achieved in that the most contaminated liquor is removed, while retaining the benefits of overflow rinsing to reduce the likelihood of redeposition of impurities onto the fabric. Through the use of this technique, a more efficient rinsing cycle results, both in terms of the time for the rinse cycle and in terms of the water consumed by the process.

As noted above, this invention also relates to the resulting method of dyeing a length of textile material as described hereinabove which includes the steps of guiding a length of textile material through a generally horizontally directed transport tube while applying a jet of liquid dye onto the material in the tube to dye the fabric and advance it through the transport tube. The textile material is then advanced downwardly from the exit end of the transport tube and reciprocated along a linear path of travel transverse to the direction of advance through the transport tube so as to form overlying relatively straight folds of the material in the transport chamber.

As can be seen from the foregoing, a jet dyeing apparatus and method according to the present invention present many distinct advantages over prior devices and techniques of this general type. In the foregoing description and accompanying drawings, there have been disclosed typical preferred embodiments of the invention and, although specific terms are employed, they are used in a generic and descriptive sense only and not for purposes of limitation, the scope of the invention being set forth in the following claims.

That which is claimed is:

1. A jet dyeing apparatus of the type used in dyeing textile materials in rope form comprising a housing having an upper portion and a lower portion, a liquid treatment chamber positioned in the lower portion of said housing and having an upwardly open inlet and an upwardly open outlet, a fabric transport tube positioned in said housing above the liquid treatment chamber comprising a generally elongate tubular member having an inlet and an exit end, and defining a path of travel for receiving and transporting a fabric article in rope form therethrough, at least one liquid application jet positioned along said fabric transport tube for applying pressurized liquid to the fabric within the fabric transport tube so as to dye the fabric and advance the fabric along the path of travel defined by the fabric transport tube, a plaiting member mounted on the exit end of the transport tube for relative rotation about the transport tube, said plaiting member including an outlet nozzle for depositing the treated fabric into the liquid treatment chamber and dye liquor bypass means for withdrawing a portion of the dye liquor flowing through the fabric transport tube and the plaiting member outside the path of travel of the fabric as the fabric is deposited by the outlet nozzle into the liquid treatment chamber.

2. A jet dyeing apparatus according to claim 1 further comprising trough means for receiving a portion of the dye liquor flowing through said dye liquor bypass means.

3. A jet dyeing apparatus according to claim 1 further comprising means for recirculating excess dye liquor in the bottom of the treatment chamber to the liquid application jet.

4. A jet dyeing apparatus according to claim 2 wherein said trough means is in fluid communicating relationship with a drain assembly for removing a portion of the excess dye liquor from the interior of the housing during a fabric rinse cycle.

5. A jet dyeing apparatus according to claim 3 wherein said means for recirculating excess dye liquor to the liquid application jet further comprises a fresh water inlet for introducing fresh water to the liquid application jet during a rinse cycle.

6. A method of rinsing a fabric article in continuous rope form within a jet dyeing apparatus of the type which includes a liquid treatment chamber positioned within a housing, a fabric transport tube positioned in the housing above the liquid treatment chamber, and a liquid application jet positioned along the length of the fabric transport tube for applying pressurized liquid dye to the fabric as it is conveyed through the transport tube, said method comprising the steps of treating the fabric in said housing with dye liquor, introducing fresh water to said liquid application jet in order to rinse the treated fabric within the fabric transport tube as it is conveyed therethrough, and removing a portion of the rinse liquid from the fabric as the fabric is discharged from the fabric transport tube so that a portion of the rinse liquid may be removed from the interior of the housing.

7. A jet dyeing apparatus of the type used in dyeing textile materials in rope form comprising a housing having an upper portion and a lower portion, a liquid treatment chamber positioned in the lower portion of said housing and having an upwardly open inlet and an upwardly open outlet, a fabric transport tube positioned in said housing above the liquid treatment chamber comprising a generally elongate tubular member having an inlet and an exit end, and defining a path of travel for receiving and transporting a fabric article in rope form therethrough, at least one liquid application jet positioned along said fabric transport tube for applying pressurized liquid to the fabric within the fabric transport tube so as to dye the fabric and advance the fabric along the path of travel defined by the fabric transport tube, a plaiting member mounted on the exit end of the transport tube for relative rotation about the transport tube, said plaiting member including an outlet nozzle for depositing the treated fabric into the liquid treatment chamber and dye liquor bypass means for withdrawing a portion of the dye liquor flowing through the fabric transport tube and the plaiting member outside the path of travel of the fabric as the fabric is deposited by the outlet nozzle into the liquid treatment chamber, a trough for receiving a portion of the dye liquor flowing through said dye liquor bypass means, and a drain assembly for removing a portion of the dye liquor from the trough during a rinse cycle.

8. A jet dyeing apparatus according to claim 7 further comprising means for recirculating excess dye liquor in the bottom of the treatment chamber to the liquid application jet.

9. A jet dyeing apparatus according to claim 8 wherein said means for recirculating excess dye liquor to the liquid application jet further comprises a fresh water inlet for introducing fresh water to the liquid application jet during a rinse cycle.

* * * * *

UNITED STATES PATENT AND TRADEMARK OFFICE

CERTIFICATE OF CORRECTION

PATENT NO. : 5,440,771

DATED : August 15, 1995

INVENTOR(S) : Aristides Georgantas

It is certified that error appears in the above-identified patent and that said Letters Patent is hereby corrected as shown below:

A portion of the text beginning at
Column 8, line 23, after the word "overlying" and continuing to line 50 through the words "appropriate sizing of" should be moved to Column 9, line 8 and inserted therein after the words "elements have". In corresponding fashion, Column 8 should be read as though the text beginning at line 50 followed directly after the word "overlying" in line 23, so that the sentence beginning at line 23 would read, "...liquid treatment chamber in overlying relatively straight folds."

Signed and Sealed this

Fifth Day of December, 1995

*Attest:*

Bruce Lehman

BRUCE LEHMAN

*Attesting Officer*

*Commissioner of Patents and Trademarks*